US007174589B2

(12) United States Patent
Mileti

(10) Patent No.: US 7,174,589 B2
(45) **Date of Patent: *Feb. 13, 2007**

(54) INFLATABLE CUSHION SYSTEMS AND METHOD OF MANUFACTURE THEREOF

(75) Inventor: Robert J. Mileti, Torrington, CT (US)

(73) Assignee: Trlby Innovative LLC, Torrington, CT (US)

( * ) Notice: Subject to any disclaimer, the term of this patent is extended or adjusted under 35 U.S.C. 154(b) by 104 days.

This patent is subject to a terminal disclaimer.

(21) Appl. No.: 10/922,307

(22) Filed: Aug. 17, 2004

(65) Prior Publication Data

US 2005/0097674 A1 May 12, 2005

Related U.S. Application Data

(63) Continuation-in-part of application No. 09/563,995, filed on May 3, 2000, now Pat. No. 6,775,868.

(51) Int. Cl.
*A47C 27/10* (2006.01)

(52) U.S. Cl. ..... 5/710; 5/711; 5/712; 5/732; 5/739; 5/699

(58) Field of Classification Search ..... 5/710–715, 5/726, 732, 737, 739, 699, 654
See application file for complete search history.

(56) References Cited

U.S. PATENT DOCUMENTS 2,604,641 A 7/1952 Reed ..... 5/710
3,772,717 A 11/1973 Yuen et al.
3,822,425 A 7/1974 Scales
4,185,341 A 1/1980 Scales
4,371,999 A 2/1983 Reid
4,422,194 A 12/1983 Viesturs et al. ..... 5/686
4,541,135 A 9/1985 Karpov
4,896,389 A 1/1990 Chamberland ..... 5/710
4,908,895 A 3/1990 Walker
4,991,244 A 2/1991 Walker
4,999,074 A 3/1991 Afeyan ..... 156/204
5,044,030 A 9/1991 Balaton
5,168,589 A 12/1992 Stroh et al. ..... 5/710
5,421,044 A 6/1995 Steensen
5,509,155 A * 4/1996 Zigarac et al. ..... 5/655.3
5,560,056 A 10/1996 Tai
5,720,061 A 2/1998 Giori et al.
5,727,270 A 3/1998 Cope et al.
5,729,853 A * 3/1998 Thompson ..... 5/713

(Continued)

FOREIGN PATENT DOCUMENTS

DE 297 17 204 10/1998

(Continued)

*Primary Examiner*—Michael Trettel
(74) *Attorney, Agent, or Firm*—St. Onge Steward Johnston & Reens LLC

(57) ABSTRACT

An inflatable device for people to sit, lie or sleep on is provided, which device allows water vapor produced by the person's perspiration or condensation to escape from the vicinity of his/her body, which device can be readily manufactured without undue amounts of human labor, which device is suitable for disposable use, and which device is of such a construction that in the event that there is a rupture or loss of pressure the entire device will not collapse.

71 Claims, 8 Drawing Sheets

U.S. PATENT DOCUMENTS

| | | | | |
|---|---|---|---|---|
| 5,755,000 | A | 5/1998 | Thompson | 5/713 |
| 5,890,245 | A | 4/1999 | Klearman et al. | |
| 5,926,884 | A * | 7/1999 | Biggie et al. | 5/714 |
| 5,956,787 | A * | 9/1999 | James et al. | 5/713 |
| 6,240,584 | B1 | 6/2001 | Perez et al. | 5/713 |
| 6,775,868 | B1 * | 8/2004 | Mileti et al. | 5/710 |

FOREIGN PATENT DOCUMENTS

| | | |
|---|---|---|
| GB | 2 267 217 | 12/1993 |
| WO | WO 95/31920 | 11/1995 |

* cited by examiner

INFLATABLE CUSHION SYSTEMS AND METHOD OF MANUFACTURE THEREOF

RELATED APPLICATIONS

This application is a continuation-in-part of U.S. patent application Ser. No. 09/563,995, filed May 3, 2000, now U.S. Pat. No. 6,775,868.

FIELD OF THE INVENTION

This invention relates to inflatable devices for supporting a body. The invention is especially applicable in the field of disposable inflatable mattresses, mattress overlays, seat cushions, and back supports, particularly those used for home-care, long-term care and hospital use.

BACKGROUND OF THE INVENTION

Inflatable devices for people to sit, lie or sleep on are well known in the prior art. Generally speaking, such cushions, when used for medical applications, are used by immobilized patients. Various types of these cushions purport to provide a reduced pressure on the body and/or relieve pressure in specific zones or on specific parts of the body. The materials of manufacture of these cushions generally do not allow water vapor produced by the person's perspiration or condensation to escape from the vicinity of his/her body, thus requiring an additional item to be placed between the patient and the support surface.

In addition, inflatable devices of the prior art are generally configured so that their construction requires a large amount of labor, usually because the formation of individual air chambers that make up the entire device need to be connected in a way that allows the chambers to be filled with air at the time of inflation, and at the same time must be placed and configured to provide suitable support to the user. The prior art designs require a time consuming assembly and mechanical joining of material to make the device, and this labor intensive construction of the air-filled devices makes them expensive, and consequently unsuitable for disposable applications, such as in a hospital environment where the devices may be contaminated by contact with a patient.

It is also a problem in the prior art that if there is a rupture or loss of pressure in an inflatable device, the entire device will collapse. The result may be that, for instance, in a hospital bed, a patient might roll off the underlying bed or mattress system, or be dropped onto an uncomfortable surface below the deflated air mattress.

What is desired, therefore, is an inflatable device for people to be supported on which allows water vapor produced by the person's perspiration or condensation to escape from the vicinity of his/her body, which can be readily manufactured without undue amounts of human labor, which is suitable for disposable use, and which is of such a construction that in the event that there is a rupture or loss of pressure the entire device will not collapse.

SUMMARY OF THE INVENTION

Accordingly, it is an object of the present invention to provide an inflatable device for people to be supported on which allows water vapor produced by the person's perspiration or condensation to escape from the vicinity of his/her body.

Another object of the present invention is to provide an inflatable device for people to be supported on having the above characteristics and which can be readily manufactured without undue amounts of human labor.

A further object of the present invention is to provide an inflatable device for people to be supported on having the above characteristics and which is suitable for disposable use.

Still another object of the present invention is to provide an inflatable device for people to be supported on having the above characteristics and which is of such a construction that in the event that there is a rupture or loss of pressure the entire device will not collapse.

These and other objects of the present invention are achieved according to one embodiment of the present invention by provision of a cover for an inflatable cushion of a material that is substantially impermeable to water vapor and can support the weight of a human being thereon by containment of air therein. The cover comprises a breathable fill sheet adapted to overlie the cushion, the fill sheet permitting the passage of air and water vapor therethrough, and a top sheet overlying the fill sheet, the top sheet being of a material that permits the passage of air or water vapor therethrough, but that blocks the passage of liquid water therethrough. At least a portion of the top sheet is permanently bonded to at least a portion of the fill sheet. When a person is in contact with the cushion, water vapor between the person and the top sheet can pass through the top sheet and through the fill sheet to a portion of the cushion displaced from the person in contact therewith.

In some embodiments, the top sheet comprises breathable micropore material. In certain of these embodiments, the top sheet comprises at least one of a polymer non-woven material and a polypropylene saturate material. In some embodiments, the fill sheet comprises polyester fill. In some embodiments, the cushion comprises at least one of polyethylene, polypropylene and polyurethane. In some embodiments, at least a portion of the top sheet and at least a portion of the cushion are permanently bonded together. In certain of these embodiments, the top sheet and the cushion are permanently bonded together around substantially all of a perimeter of the top sheet and a perimeter of the cushion.

In some embodiments, perimeters of the top sheet, the fill layer and the cushion are bonded together by at least one of heat sealing, sewing, and gluing. In some embodiments, the cushion is configured and inflated, and the fill sheet is selected of such a material, such that the compressibility of the fill sheet is less than that of the cushion so that the weight of the person does not compress the fill sheet against the cushion and block the breathability of the fill sheet. In some embodiments, the cushion comprises a mattress. In some embodiments, the cushion comprises a seat cushion. In some embodiments, the fill sheet and the top sheet are laminated together to form an integral sheet.

In accordance with another embodiment of the present invention, an inflatable cushion comprises first and second sheets of polymeric material extending longitudinally and laterally and being secured together to form longitudinally spaced laterally extending support tubes. The support tubes are pneumatically enclosed so as to be able to contain air therein at a pressure sufficient to support a person or portion thereof on the cushion, and support tubes have lateral ends wherein material is bonded together, allowing the support tubes to inflate, First and second laterally spaced, longitudinally extending side tubes are located adjacent respective lateral ends of the support tubes. The sheets have therebetween a first air passage communicating with a plurality of the support tubes so that air may be supplied to the support tubes through the air passage to inflate or maintain air pressure in the support tubes, and a second passage therebetween communicating with others of the support tubes and allowing delivery of air thereto. The first and second passages communicate with alternating support tubes over the longitudinal length of the cushion.

In some embodiments, the cushion further comprises a third passage communicating with others of the support tubes and allowing delivery of air thereto, and wherein the first, second and third passages communicate with alternating support tubes over the longitudinal length of the cushion. In some embodiments, the first passage communicates with the support tubes at longitudinal ends of the cushion, to provide inflated end rails, and the second passage communicates with the support tubes therebetween. In some embodiments, each of the side tubes comprises an interior and each being connected with a respective set of the lateral ends of the support tubes. In certain of these embodiments, the cushion further comprises a side rail air flow structure connected with the sheets and defining passages communicating with the interiors of the side tubes so that air introduced between the sheets can pass into the side tubes. In some embodiments, the cushion comprises a mattress. In some embodiments, the cushion comprises a seat cushion.

In accordance with another embodiment of the present invention, an inflatable cushion comprises first and second sheets of polymeric material extending longitudinally and laterally and being secured together to form longitudinally spaced laterally extending support tubes, the support tubes being pneumatically enclosed so as to be able to contain air therein at a pressure sufficient to support a person or portion thereof on the cushion. The support tubes have lateral ends wherein the material of the tubes is bonded together, allowing the support tubes to inflate. First and second laterally spaced, longitudinally extending side tubes are located adjacent respective lateral ends of the support tubes, the side tubes each having an interior and each being connected with a respective set of the lateral ends of the support tubes. A side rail air flow structure is connected with the sheets and defines passages communicating with the interiors of the side tubes so that air introduced between the sheets can pass into the side tubes. The side rail air flow structures are configured so that air can flow therethrough only into, and not out of, the interiors of the side tubes.

In some embodiments, the side rail air flow structures comprise one-way flutter valve structures.

In accordance with still another embodiment of the present invention, an inflatable cushion comprises first and second sheets of polymeric material extending longitudinally and laterally and being secured together to form longitudinally spaced laterally extending support tubes, the support tubes being pneumatically enclosed so as to be able to contain air therein at a pressure sufficient to support a person or portion thereof on the cushion. The support tubes have lateral ends wherein the material of the tubes is bonded together, allowing the support tubes to inflate. First and second laterally spaced, longitudinally extending side tubes are located adjacent respective lateral ends of the support tubes, and a center sheet is bonded between the two sheets of polymeric material, the center sheet defining in each of the support tubes a lower tube interior and an upper tube interior.

In some embodiments, the cushion further comprises air flow means permitting passage of air in the upper tube interior into the lower tube interior. In certain of these embodiments, the air flow means prevents passage of air in the lower tube interior into the upper tube interior so that, in the event of a loss of pressure in the upper tube interior, pressure is nonetheless maintained in the lower tube interior.

In accordance with still another embodiment of the present invention, an inflatable cushion comprises first and second sheets of polymeric material extending longitudinally and laterally and being secured together to form longitudinally spaced laterally extending support tubes, the support tubes being pneumatically enclosed so as to be able to contain air therein at a pressure sufficient to support a person or portion thereof on the cushion. The support tubes have lateral ends wherein the material of the tubes is bonded together, allowing the support tubes to inflate. First and second laterally spaced, longitudinally extending side tubes are adjacent respective lateral ends of the support tubes. The sheets have therebetween a first air passage communicating with a plurality of the support tubes so that air may be supplied to the support tubes through the air passage to inflate or maintain air pressure in the support tubes, and a second passage therebetween communicating with others of the support tubes and allowing delivery of air thereto. The first passage communicates with the support tubes at longitudinal ends of the cushion, to provide inflated ends of the cushion, and the second passage communicates with the support tubes therebetween. An air flow structure forms a tube extending generally longitudinally between the first and second sheets and defines a passage therein communicating with some of the support tubes to permit supply of air thereto.

In some embodiments, the cushion further comprises a second air flow structure forming a second tube extending generally longitudinally between the first and second sheets and defining therein a second passage communicating with others of the support tubes. In certain of these embodiments, the cushion further comprises a third air flow structure forming a third tube extending generally longitudinally between the first and second sheets and defining therein a third passage communicating with others of the support tubes. In certain embodiments, the first and second passages each communicate with respective side tubes for supplying air thereto. In certain embodiments, the first, second and third passages each communicate with respective side tubes for supplying air thereto.

In some embodiments, the cushion further comprises one-way flow structures between the side tubes and the associated passages so that air can flow only from the passage into the associated side tube, and not in the opposite direction, so that the side tubes do not immediately deflate when pressure leaves the passage. In certain embodiments, the flow structures include means defining apertures connecting the side tubes with lower tube interiors so that the side tubes and the lower tube interiors remain inflated even when air is not supplied through the passages. In some embodiments, the cushion comprises a mattress. In some embodiments, the cushion comprises a seat cushion.

In accordance with still a further embodiment of the present invention, an inflatable cushion system comprises first and second sheets of polymeric material extending longitudinally and laterally and being secured together to form longitudinally spaced laterally extending support tubes, the support tubes being pneumatically enclosed so as to be able to contain air therein at a pressure sufficient to support a person or portion thereof on the cushion. The support tubes have lateral ends wherein the material of the tubes is bonded together, allowing the support tubes to inflate. First and second laterally spaced, longitudinally extending side tubes are adjacent respective lateral ends of the support tubes. A fill layer of porous material overlies at least one of the first and second sheets of polymeric material, and a top sheet overlies the fill layer. The top sheet is of a material that prevents the passage of liquid water but allows the passage of water vapor, whereby water vapor for a user in contact with the cushion can pass through the top layer, through the fill layer, and away from the user.

In some embodiments, the top sheet is connected with the support tubes to remain in place thereon. In some embodiments, the fill layer and top sheet span areas between high points of the support tubes and provide support of the user therebetween. In some embodiments, the cushion comprises a mattress. In some embodiments, the cushion comprises a seat cushion.

In accordance with another embodiment of the present invention, an inflatable cushion system comprises an inflatable cushion and a pump supplying air to the inflatable cushion for inflation thereof. The inflatable cushion comprises a middle portion receiving air from the pump and being inflated thereby, the middle portion having two lateral sides, and a pair of side tubes each attached to a respective side of the middle portion. The middle portion includes air flow structures transmitting air in the middle portion to the side tubes, the air flow structures blocking air flow therethrough from the side tubes to the middle portion so that, when the middle portion deflates or loses air pressure therein, the side tubes remain inflated.

In some embodiments, the middle portion defines therein an interior space and the middle portion includes a center sheet dividing the interior space into one or more upper spaces and one or more lower spaces. In some embodiments, the middle portion comprises a bottom sheet defining the lower space or spaces therewith. In certain of these embodiments, the bottom sheet is connected to a lower surface of the center sheet in a plurality of locations so as to form a plurality of laterally extending lower support tubes defining the lower spaces. In certain of these embodiments, the bottom sheet is connected to the center sheet so as to form downwardly disposed recesses extending laterally across the cushion so as to provide for easier bending of the cushion on an articulated frame. In certain embodiments, the middle portion comprises an upper sheet connected to an upper surface of the center sheet in a plurality of locations so as to form a plurality of laterally extending upper support tubes defining the upper spaces. In certain embodiments, the upper sheet, the center sheet, and the bottom sheet are all bonded together in laterally extending seals so as to form a plurality of support tubes between the side tubes. In certain embodiments, the side tubes each comprise an interior communicating with the lower spaces of the lower support tubes so that air flows therebetween, and so that, if the upper support tubes lose air pressure, the lower support tubes and the side tubes remain inflated. In some embodiments, the side tubes each comprise an interior communicating with the lower spaces so that, in the event of a loss of pressure in the upper spaces, the middle portion lower spaces and the side tubes remain inflated.

In some embodiments, the cushion further comprises a fill sheet of porous material overlying the support tubes and a top sheet overlying the fill layer and being connected with the support tubes to remain in place thereon, the top sheet being of a material that prevents the passage of liquid water but allows the passage of water vapor, whereby water vapor for a user in contact with the cushion can pass through the top layer, through the fill layer, and away from the user. In certain of these embodiments, the fill layer and top sheet span areas between high points of the support tubes and provide support of the user therebetween. In some embodiments, the cushion comprises a mattress. In some embodiments, the cushion comprises a seat cushion.

In accordance with yet still a further embodiment of the present invention, an inflatable cushion comprises first and second sheets of polymeric material extending longitudinally and laterally and being secured together to form longitudinally spaced laterally extending support tubes, the support tubes being pneumatically enclosed so as to be able to contain air therein at a pressure sufficient to support a person or portion thereof on the cushion. The support tubes have lateral ends wherein the material of the tubes is bonded together, allowing the support tubes to inflate. A center sheet is bonded between the two sheets of polymeric material, the center sheet defining in each of the support tubes a lower tube interior and an upper tube interior.

In some embodiments, the cushion further comprises air flow means permitting passage of air in the upper tube interior into the lower tube interior. In certain of these embodiments, the air flow means prevent passage of air in the lower tube interior into the upper tube interior so that, in the event of a loss of pressure in the upper tube interior, pressure is nonetheless maintained in the lower tube interior. In some embodiments, the cushion comprises a mattress. In some embodiments, the cushion comprises a seat cushion.

The invention and its particular features and advantages will become more apparent from the following detailed description considered with reference to the accompanying drawings.

DETAILED DESCRIPTION OF AN EMBODIMENT OF THE INVENTION

Figure 1:
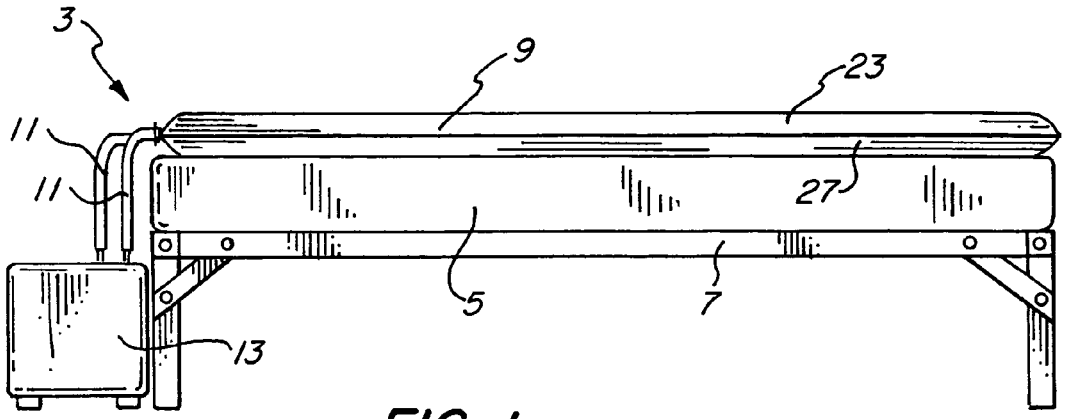
FIG. 1 is an elevational view of a inflatable cushion system in accordance with an embodiment of the present invention in place on a bed.

As best seen in FIG. 1, an inflatable cushion system in accordance with the present invention is generally indicated at 3. The inflatable cushion system 3 may comprise an inflatable mattress and/or mattress topper (as shown in FIG. 1), in which case, the inflatable cushion is preferably supported on a mattress 5 of conventional design which is usually supported on a frame or other structure 7. It will be understood, of course, that a variety of different bed frames can be used, particularly in the hospital or home care environment where this invention is especially useful.

Figure 13:
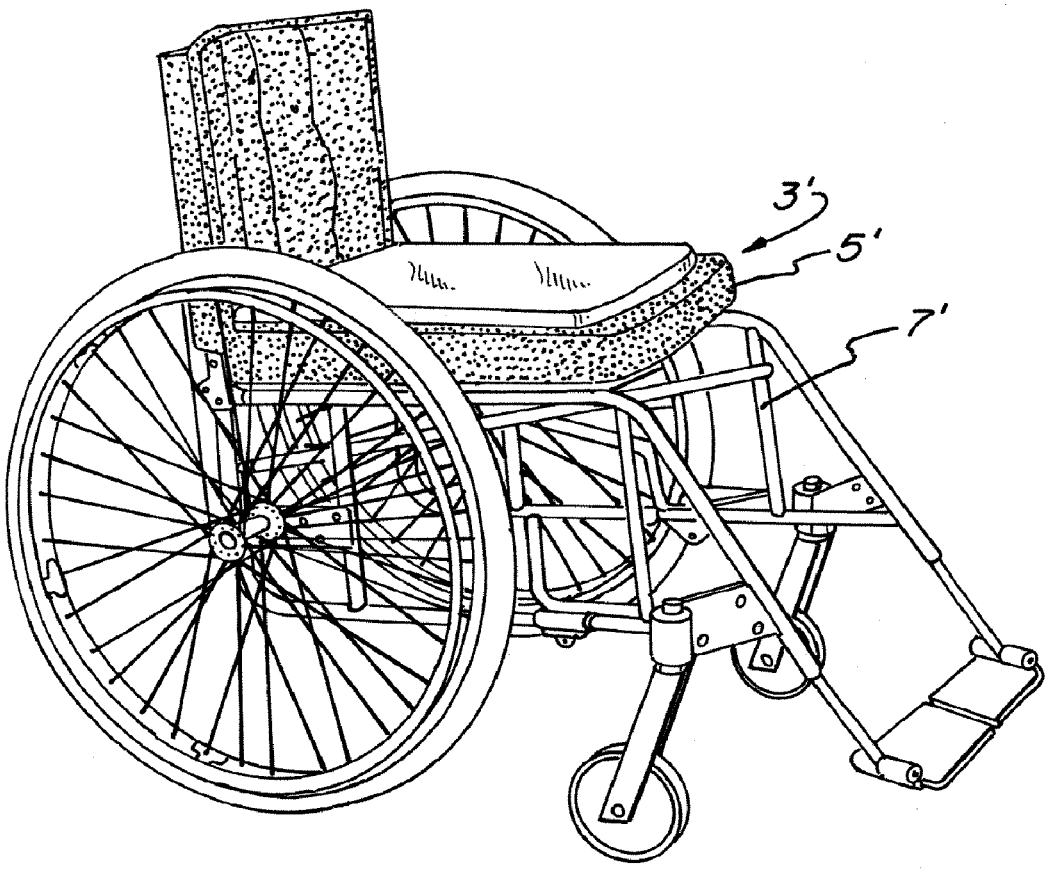
FIG. 13 is a perspective view of a inflatable cushion system in accordance with an embodiment of the present invention in place on a wheelchair.

The inflatable cushion system 3' may just as easily, however, comprise an inflatable seat cushion and/or seat cushion topper (as shown in FIG. 13), in which case, the inflatable cushion is preferably supported on seat cushion 5' of conventional design which is usually supported on a frame or other structure 7'. It will be understood, of course, that a variety of different seat frames can be used, particularly in the hospital or home care environment where this invention is especially useful, such as in connection with a wheelchair or other similar device.

Figure 2:
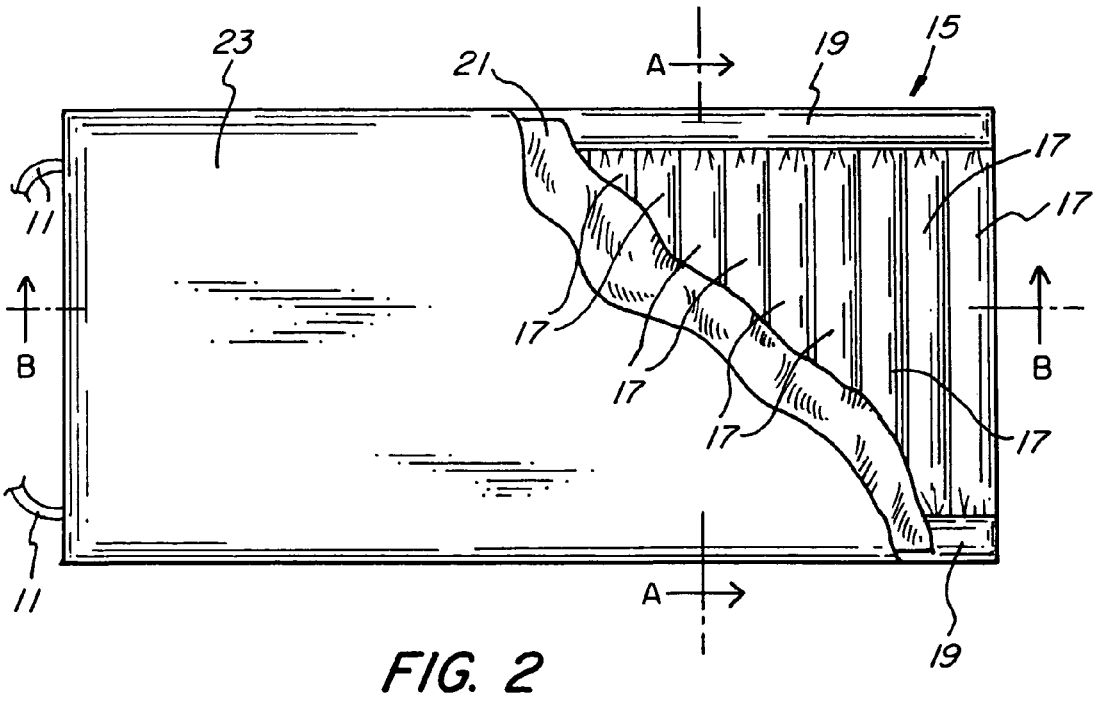
FIG. 2 is a partly cut-away plan view of the inflatable cushion system of FIG. 1.

Referring again to FIG. 1, the cushion system comprises an inflatable portion 9 which is connected by a plurality of hoses 11 to pump 13, which supplies air through the hoses 11 to inflate the inflatable portion 9. As best seen in FIG. 2, the inflatable portion 9 includes an inflatable cushion generally indicated at 15 which has a laterally middle portion that comprises a plurality of laterally extending, longitudinally spaced support tubes 17 over the entire length of the cushion. The air cushion also comprises first and second laterally longitudinal extending side rail tubes 19 which extend the entire length of the cushion adjacent the lateral ends of the support tubes 17 on either lateral side of the middle portion. Each of the tubes 17 and 19 is generally cylindrical in shape, with a diameter of approximately 4 inches.

The inflatable cushion is of material suitable for containing air under sufficient pressure to support a person on the inflatable portion 9. A variety of materials may be used effectively in this application, but the material is preferably a thermoplastic. Particularly preferred is polyethylene, such as the polyethylene material sold under the name "Metalecene" by Dow Chemical, Exxon or Mobil Corporation, although other materials such as polypropylene or polyurethane may also be used. The thickness of the polyethylene used may range from about 2 to about 25 mils, but particularly preferred is material of about 3 to 5 mils.

To provide for a breathable environment adjacent to the skin of a person in contact with the inflatable portion 9, the cushion 15 is covered by a fill or batting layer 21 which extends over substantially all of the upper surface of the cushion 15 and may be glued or thermally bonded in place to the material of cushion 15. A top sheet or outer layer 23 covers the fill layer 21 and the entire upper surface of the cushion 15, and may be bonded to the perimeter thereof, preferably by a thermal seal. Alternately, the fill or batting layer and the top sheet or outer layer 23 may form part of a cover which is not attached or bonded to cushion 15, but rather which may be slipped over cushion 15 and removed therefrom. If desired, the outer layer 23 and the fill layer 21 may be laminated or otherwise joined to form an integral unit.

The top sheet 23 is formed of a breathable material that permits the passage of water vapor therethrough, but which does not permit liquid water to pass and is preferably bacteria-proof and or bacteria-resistant. Materials of this type are known in the disposable diaper arts. Particularly effective for this purpose is micropore material such as a polyester non wovens or polypropylene saturate material. The top sheet 23 permits water vapor from the perspiration of the person on the cushion 9 to pass through it and enter into the fill layer 21.

The main purpose of the fill layer 21 is to provide loft to create an air space between the top sheet 23 and the non-breathable material of the cushion 15 through which the user's water vapor can escape and then pass out of the system through the top layer 23 in a location where this will not cause discomfort to the user. Fill layer 21 is consequently of material that allows air and water vapor to pass therethrough fairly freely, and that resists retaining much moisture. Particularly preferred materials are polyester fill, and especially preferred is Dacron. Also, generally speaking, the mechanical nature of the fill layer material is such that it is less compressible than the underlying inflated cushion 15, so that the tubes 17 and 19 compress before the fill layer 21, and the loft thereof is maintained despite the weight of the patient pressing the fill layer 21 against cushion 15.

The top sheet 23 may be an integral structural part of the inflatable portion 9 in certain embodiments. In these embodiments, the fact that the top sheet 23 is bonded to the cushion substantially completely around its outer edge perimeter structurally ties the top sheet into the load bearing of supporting the user. However, as mentioned above, in other embodiments, the top sheet 23 is not attached to or bonded to the inflatable portion, but rather forms part of a cover which is removable from the inflatable portion 9 for example, for ease of drying, cleaning and/or replacing.

Figure 4:
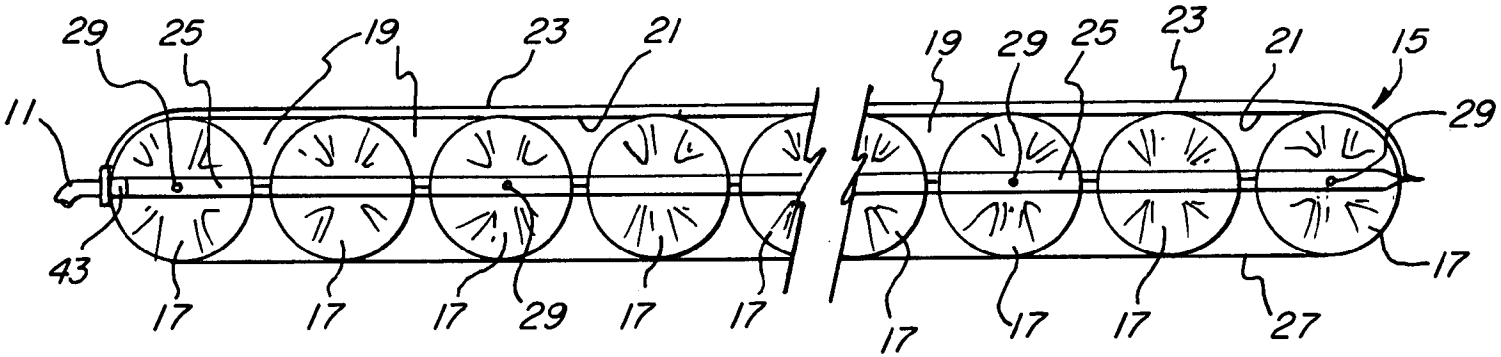
FIG. 4 is a partially cross-sectional side view of the inflatable cushion system taken through line B—B of FIG. 2.

The thickness of the top sheet 23 protects the cushion 15, and allows thinner material to be used in the cushion because it is protected better against puncture by the top sheet 23. Also, as best seen in FIG. 4, the top sheet 23 and fill layer 21 overlie the support tubes 17 and depend between the adjacent peaks of the tubes 17. When the user lies or sits on the top sheet 23, the top sheet 23 and fill layer 21 together act to "tent" between adjacent support tubes 17, providing a more supportive flat surface on the top of the cushion portion 9.

The cushion portion 9 is also provided with a protective bottom sheet 27 of a durable material, with heavy polyester non woven material being especially desirable. This bottom sheet 27 protects the air cushion from being punctured from below. The bottom sheet 27, like the top sheet 23, may be bonded to the cushion 15 around virtually all of the outer perimeter edge of the cushion 15, preferably in the same heat seal as is used to bond the top sheet 23 to the cushion 15 when the top sheet 23 is so bonded to the cushion 15. Bottom sheet 27 also cooperates structurally with the cushion 15 to provide a flat and stable support surface of the cushion portion 9 for the user to lie and/or sit on. The various layers may be bonded together by any of numerous means. Thus, although heat sealing is preferred in some embodiments, bonding may also be achieved by way of gluing, sewing, etc.

To inflate and maintain pressure in the cushion 15, electrically powered pump 13 supplies air under pressure through hoses 11, which air flows into cushion 15 and inflates the support tubes 17 and the side rail tubes 19. The hoses 11 are connected with longitudinally extending air tubes 25 which define passages therein that communicate with support tubes 17 and transmit the air supplied by the pump 13 thereto.

Figure 3:
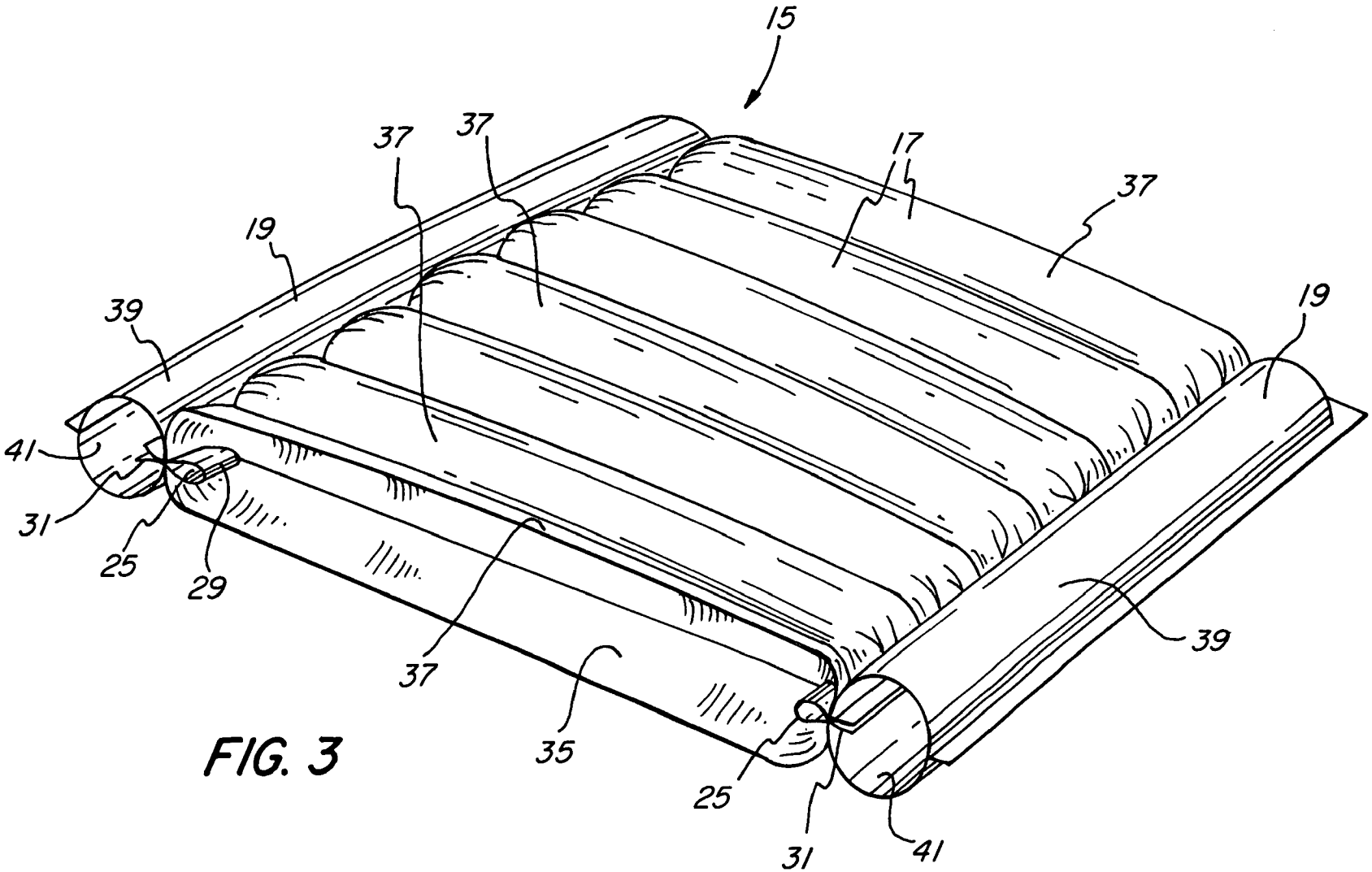
FIG. 3 is a partially cross-sectional perspective view of the cushion portion of the inflatable cushion system taken through line A—A of FIG. 2.

In one embodiment, as best seen in FIGS. 3 and 4, the passages in the air supply tubes 25 extend longitudinally through the cushion 15 but in one tube 25 apertures 29 are provided which communicate with the interior of a set of the support tubes 17, and in the other tube 25, apertures 29 are provided which communicate with the remaining support tubes 17. In the embodiment shown in FIG. 4, one air supply tube supplies air to every other support tube 17, and the other air supply tube 25 supplies air to the other support tubes 17 between them. Such an arrangement affords some degree of extra reliability, because, in the event that there is a failure of air supply or a tear in a support tube 17 of one of the sets of support tubes, the other set of support tubes 17 should still retain air pressure to support the user.

Alternatively, one air supply tube 25 may supply air to the first and last support tubes 17, defining with the side rail tubes 19 a rectangular frame, while the remaining longitudinally inward support tubes 17 are supplied with air by the other air supply tube. Also, if desired, additional air supply tubes 25 maybe added to the design to define other patterns of sets of support tubes 17 for special purposes.

In the most common application of the invention, the cushion is inflated fully and the user lies and/or sits thereon, with the pump 13 activated only to the degree necessary to keep the air cushion 15 inflated. Increased comfort may be afforded to the user by forming small holes in the upper surface of the cushion 15 so that air pumped into the cushion can flow out through the upper sheet 33 of the support tubes 17, and through the fill layer 21, to better ventilate the points of contact of the user's body with the cushion 15.

It is an alternative aspect of invention to provide for prevention of bed sores in patients who are required to stay in bed for long periods of time, and the arrangement wherein each air supply tube 25 supplies air to alternating support tubes 17 is especially appropriate for this purpose. In this application, pump 13 alternates supplying air to one of the hoses 11 with the other of the hoses 11. By switching the supply of air from one hose 11 to the other periodically, the user is alternately supported by the "odd numbered" support tubes 17 and then the "even numbered" support tubes 17. Of course, other alternate pumping schemes are possible. For example, a third hose may be provided and the user may alternately be supported by every third or every two thirds support tubes 17. In such an application, the upper surface of the support tubes 17 may be punctured to a small degree, e.g., in pinpricks, to allow the escape of air therethrough so that deflation occurs fairly readily in tubes that are not being sent air, and also to ventilate the locations under the patient. The resulting system allows for continuous variations in the location of support of the patient, which prevents the formation of bed sores.

As best seen in FIGS. 3 and 4, the air supply tubes 25 are on either side of the cushion 15, each adjacent a respective side rail tube 19. The passages in the air supply tubes 25 also deliver air to the adjacent side rail tube 19. The air passes from the air supply tube through a flutter valve 31 formed by the ends of the air supply tube material (FIG. 3). These ends are heat sealed together, but intermittently so that air can flow from the passage in air tubes 25 into the interior of the side rail 19. The flutter valves 31 are one way valves, and do not permit the air to flow back in the reverse direction, i.e., from the side rail into the air tube 25.

The flutter valves 31 retain pressure in the side rails 19 even if the pump completely fails or if the support tubes 17 in the lateral middle of the cushion 15 completely deflate. This is especially advantageous in a hospital situation, because the side rails 19, while still inflated, will keep a patient from simply rolling out of bed in the event the cushion 15 partially deflates.

The method of fabrication of the air cushion 15 is also a particularly desirable aspect of the present invention because the cushion is constructed as a continuous sheet of bonded materials. The process of manufacture is schematically explained in FIG. 5. It will be understood that, while one side rail construction is shown, an equivalent symmetrical construction is applied on the opposite lateral side of cushion 15.

The first step in fabrication of the cushion 15 is that two sheets 33 and 35, which will become the upper and lower halves of the support tubes 17, are bonded together with the folded air tube sheet 37, which will become the air supply tube 25, by laterally extending heat seals. Sheet 37 is already provided with punched holes 29 therein before being sealed in place.

The heat seals are applied every 4 inches along sheet 37, because that will be the diameter of the support tube 17 when inflated. However, the relative lengths of top and bottom tube sheets 33 and 35 bonded to a 4-inch length of the folded air tube sheet 37 is greater, because the support tubes will inflate to a larger diameter. Therefore, these heat seals are applied with pleats or gussets folded into the sheets 33 and 35 to allow them to swell to a cylindrical shape without distorting the air supply tube 25.

The heat seal bonds sheets 33 and 35 to the outside face of sheet 37, but does not bond the inside faces of sheet 37 to each other. The interior passage defined by sheet 37 is kept open to allow air to flow down the resulting tube 25. Heat sealing on the inside of the tube is prevented by the use of a Teflon or paper insert, which will not permit the sheet 37 to heat seal to itself. Alternatively, ink may be used on the inside of the folded sheet 37, which will also prevent the heat seal from closing the interior of the tube 25.

Figure 5:
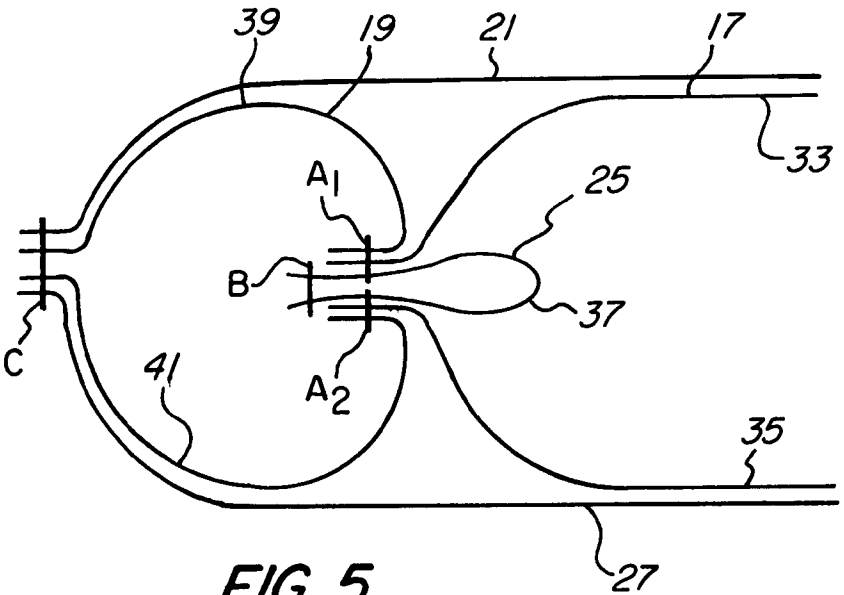
FIG. 5 shows schematically a sealing process for the construction of an inflatable cushion portion of the inflatable cushion system shown in FIG. 1.

Once this basic structure is formed, the remaining heat seals are longitudinal, and are illustrated in FIG. 5. First, heat seals A1 and A2 are applied, bonding support tube sheet 33 with part of air tube sheet 37 and a side rail top sheet 39, and bonding support tube sheet 35 with another part of sheet 37 and side rail bottom sheet 41. Second, heat seal B is applied to form the flutter valve on the air supply tube 25. This seal B is not continuous, but has gaps therein which will allow air to flow through between the two parts of the sheet 37 into the side rail 19. Thirdly, the outer edge of the side rail sheets 39 and 41 are heat sealed together by seal C, preferably (but not necessarily) also sealing the edge simultaneously with top sheet 23 and bottom cover sheet 27. The fill layer 21 is installed below top layer 23 before seal C, or, if the batting material is compatible, the fill layer 21 may also be heat sealed along the outer edge of the cushion 15 together with top sheet 23.

This fabrication process produces a continuous roll of cushion material. To make an individual cushion therefrom, the manufacturer cuts the roll material in a lateral cut to a length suitable for a cushion. At one end of the cut material, the manufacturer heat seals the open ends of the side rails 19 and the air supply tube 25. At the other end, the manufacturer heat seals the open ends of the side rails 19, but inserts hose fixtures 43 into the open ends of air supply tubes 25 to allow the tubes 11 to pump 13 to be attached thereto. The cushion is then ready to use.

Figure 6:
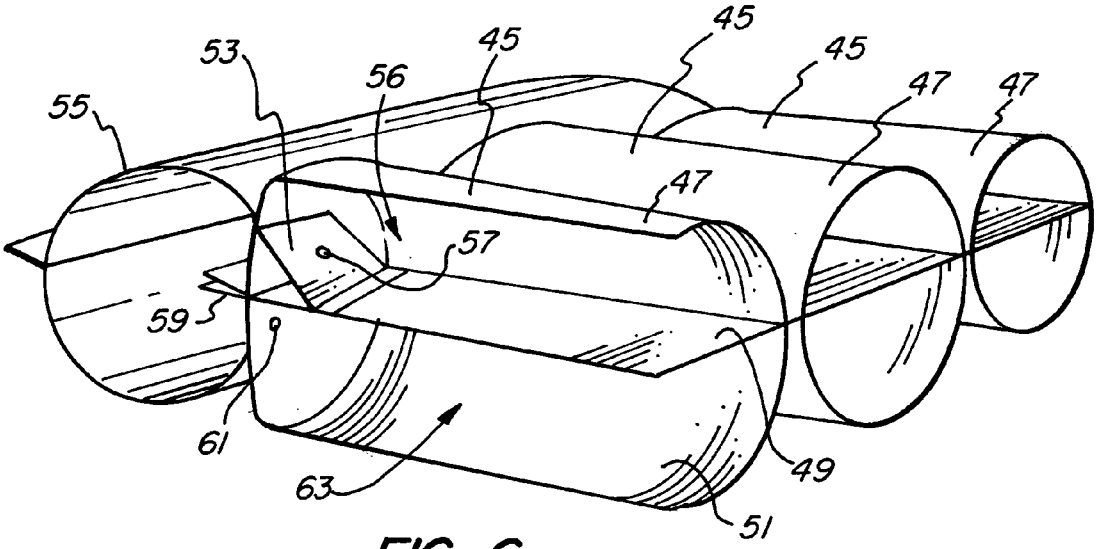
FIG. 6 is a perspective view of an alternate embodiment of an inflatable cushion in accordance with the present invention cut away along both a longitudinal and lateral plane.

An alternate embodiment of the cushion of the invention is shown in FIG. 6, which shares many features with the above-described embodiment. In the alternate embodiment, support tubes 45 are formed of a support tube top sheet 47, a center sheet 49, and a bottom sheet 51. A longitudinally extending air supply tube structure 53 is provided adjacent each side rail 55. This air supply tube 53 supplies air into the upper support tube interior indicated at 56 through aperture 57 and into side rail 55 through flutter valve 59. The air supply tubes 53 preferably communicate with alternating support tubes as in the above-described embodiment.

Figure 7:
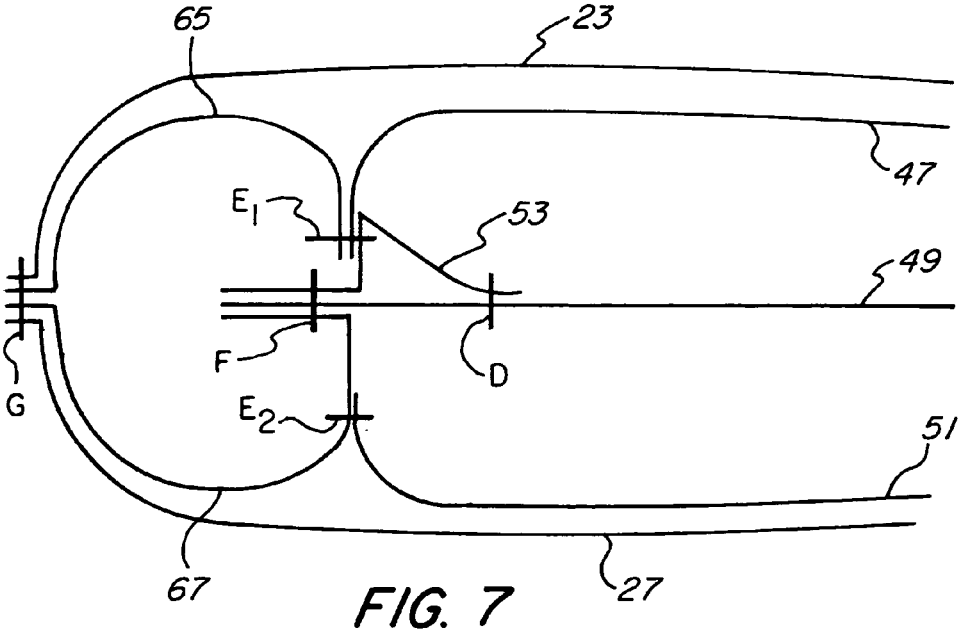
FIG. 7 shows schematically a sealing process for the construction of the inflatable cushion shown in FIG. 6.

Side rails 55 have apertures 61 therein which communicate with the lower support tube interior of all of the support tubes 45, indicated at 63. Because of one-way flutter valve 59, the air in the lower interior 63 and in the side rails 55 remains pressurized even if the pump 13 fails or the top interior 56 deflates. In such an event, the lower half of the support tubes 45 continue to support the user above the cushion below. Manufacture of such a cushion is similar to the process described above, with certain adjustments to allow for the presence of the center sheet 49. Referring to FIG. 7, in fabrication, a longitudinal heat seal D is made sealing air supply structure 53 to center sheet 49. Then lateral heat seals (not shown) are applied in a manner similar to that in the embodiment described above, i.e., with the material of top and bottom sheets 47 and 51 gusseted to allow for inflation. Heat seals $E_1$ and $E_2$ join the support tube top sheet 47 with side rail top sheet 65, and join support tube bottom sheet 51 with side rail bottom sheet 67. Intermittent seal F is applied to create flutter valve 59 leading into side rail 55. Side rail 55 is then closed by sealing the lateral outward edge thereof, together with top sheet 23, bottom sheet 27, and, optionally, fill layer 21, which may be sealed in the same operation if the materials are compatible.

Both of the above-described embodiments provide for an inflatable air cushion system about 4-inches thick, the diameter of the support tubes 17. Such an air cushion is suitable for use where there is another cushion on the bed, seat or other surface, but if no cushion is available, the 4-inch thick arrangement may not be adequately comfortable for the user. Accordingly, it may be desired to increase the thickness of the cushion.

Figure 8:
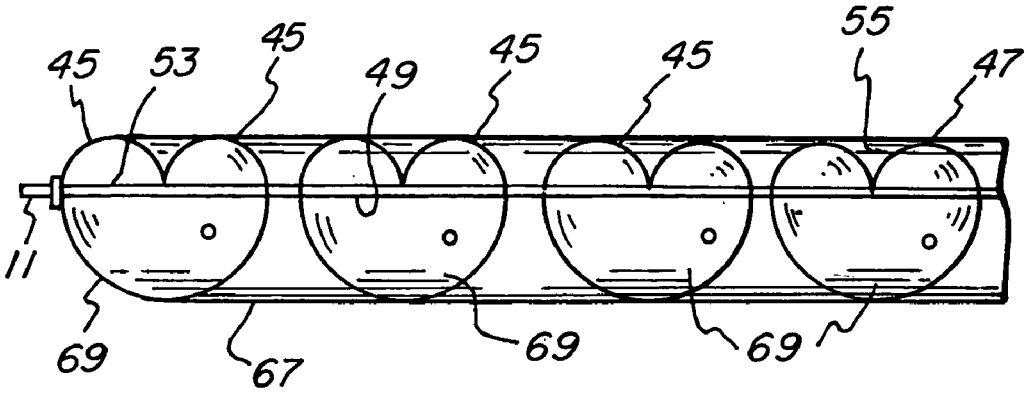
FIG. 8 is a longitudinal partially cross-sectional view of an alternate embodiment of the inflatable cushion shown in FIG. 6.

Increasing the thickness of the cushion is possible using the structure of the alternate embodiment having the center sheet 49. As best seen in FIG. 8, a view showing a longitudinal cross-section of a further alternate embodiment, the cushion may be thickened by providing underneath center sheet 49 enlarged support tubes 69, which have a diameter approximately twice that of the upper support tubes 45. The lower wall 68 of the side rail 55 is also extended to increase this dimension below the center sheet 49. This design provides for an additional 2 inches of thickness in the cushion.

Figure 9:
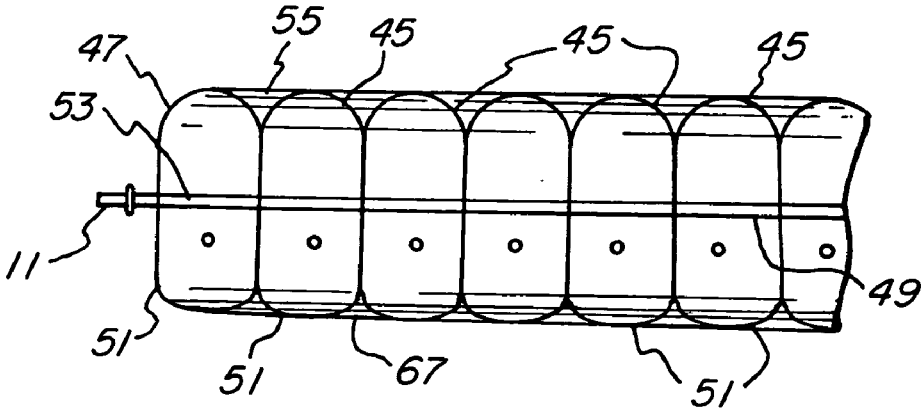
FIG. 9 is a longitudinal partially cross-sectional view of a further alternate embodiment of the inflatable cushion shown in FIG. 6.

FIG. 9 shows another alternate embodiment wherein the upper and lower support tubes 45 are extended by producing longer amounts of material in the sheet 47 and 51 as gusseted, so that the inflated tube expands to a greater height. The side rails 55 are similarly provided with additional material for increased height of the cushion.

Where no traditional cushion is provided for the bed, seat or other surface, and all support of the user is to be provided by an inflated air cushion, it is generally preferred, particularly in hospital and home-care environments, that an inflatable cushion of at least 8 inches in height be provided.

Figure 10:
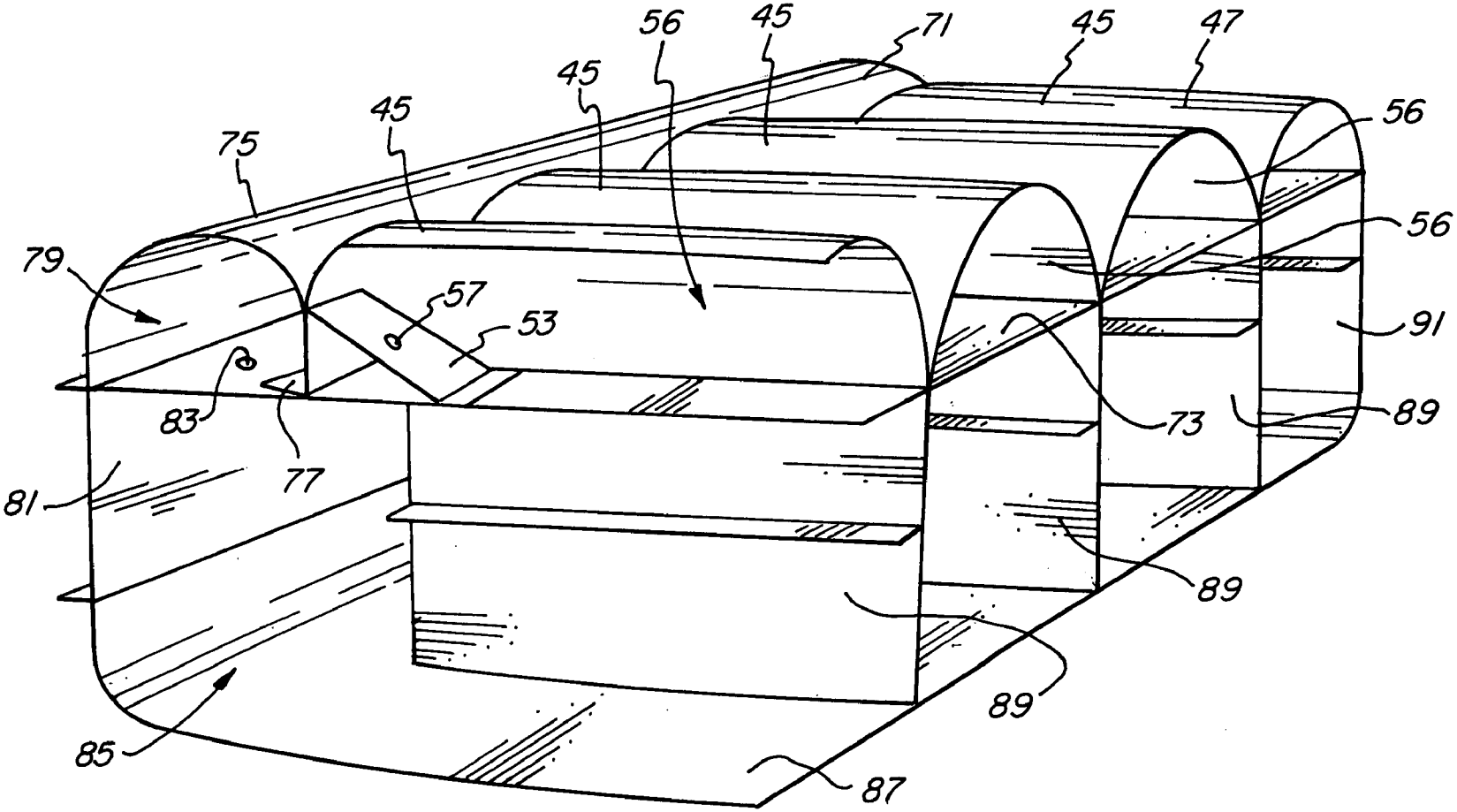
FIG. 10 is a perspective view of a further alternate embodiment of an inflatable cushion according to the present invention cut away at longitudinal and lateral planes therethrough.
Figure 11:
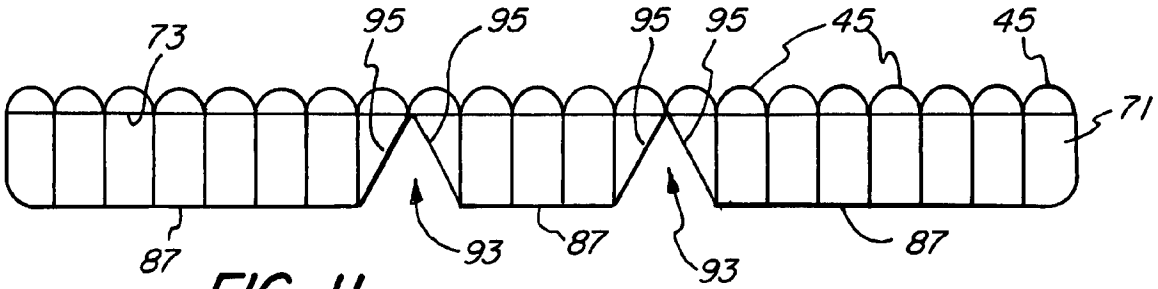
FIG. 11 is a longitudinal partially cross-sectional view taken through the inflatable cushion shown in FIG. 10.
Figure 12:
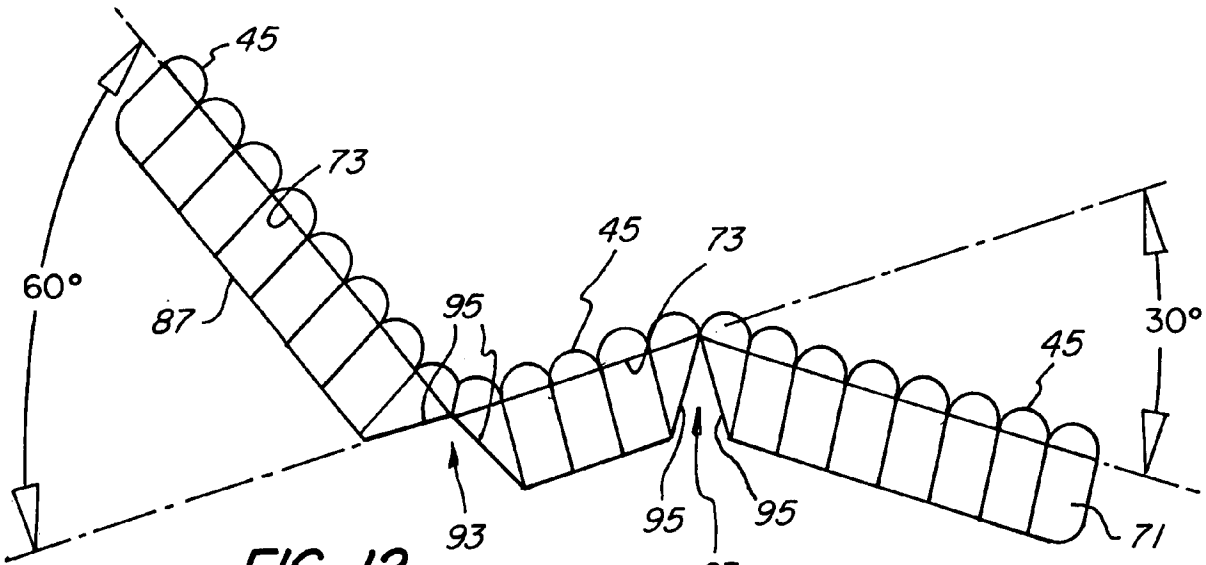
FIG. 12 is a schematic representation of the articulation provided by the inflatable cushion shown in FIG. 10.

FIGS. 10 to 12 show an alternate embodiment which provides an inflated cushion of appropriate height according to the present invention. Many aspects of this structure are similar to those of the embodiment shown in FIGS. 6 and 7, and similar parts are given the same reference characters.

The upper surface of the air cushion 71 comprises a series of laterally extending support tubes 45 having a diameter of approximately 4 inches. These support tubes 45 are formed of a sheet 47 secured to the upper surface of a center sheet 73, which extends substantially the entire length and lateral width of the cushion 71.

Air is supplied through air supply tubes defined by tube structure 53, which is similar to that shown in the embodiment shown in FIG. 6. An aperture or punch hole 57 in the structure 53 allows air pumped therein to enter into the upper support tube interior space indicated at 56. A side rail 75 is provided on each lateral side of the cushion 71. Flutter valve structure 77 permits air in the passage 53 to also pass into upper side rail interior space 79.

Center sheet 73 extends below the upper side rail 75 to outer wall 81 of the air cushion 71 and is secured thereto. For distribution of air, center sheet 73 is provided in the region of the side rail 75 with a plurality of apertures or punch holes 83 through which air may pass from the interior space 79 of the side rail 75 down into a lower interior space generally indicated at 85, in the air cushion 71. The lower space 85 of the air cushion 71 is defined by the cover sheet 73, the side wall 81, and a bottom enclosure sheet 87. In order to support the upper surface tubes 45 of the cushion so that there is not an undue amount of lateral or longitudinal movement possible, a plurality of support panels 89 are provided linking the bottom closure sheet 87 with the center sheet 73. At the longitudinal ends of the cushion the panel is extended to seal against the side wall 81, to fully enclose the lower space.

In the event of a failure of the pump 13, which supplies air to the air supply passage 53, or in the event of a rupture of the upper surface of the cushion causing deflation of support tubes 45, the side rail 75 remains inflated due to the one-way passage of air in flutter valve 77, which prevents air in the side rail interior space 79 from passing back into the air supply passage 53. Furthermore, because side rail space 79 communicates with the lower space 85 of the cushion through aperture 83, air in the lower space 85 also is prevented from leaving.

As a consequence, in the event of a failure of the pump 13 or the upper support tubes 45, the cushion 71 will still retain air therein, and the patient will lie on a flat surface defined by cover sheet 73, supported on inflated lower space 85, and between inflated side rails 75 which will also remain inflated. This of course is especially important where the inflatable cushion is used on a bare surface or bedspring, to prevent a rupture from dropping onto an uncomfortable surface below the cushion 71.

Where the cushion 71 is used in an environment with a bed with some articulation, such as a hospital or home-care bed, the thickness of the cushion 71 does not admit to easy folding. Accordingly, as best shown in FIGS. 11 and 12, the bottom sheet 87 and the side walls 81 are interrupted in two locations to create an articulating recess generally indicated at 93. At these recesses, the lower surface sheet 87 extends up to center sheet 73, as a sloping bottom wall 95 on either side of the recess 93, which allows substantial bending movement, as seen in FIG. 12.

Construction of the cushion 71 of this alternate embodiment with respect to the top portion of the air cushion 71, i.e., that portion that is above the center sheet 73, is accomplished using methods similar to those described with respect to the embodiment shown in FIGS. 6 and 7. The lower portion, i.e., the side and bottom walls 81, 87 and the support panels 89 and end walls 91, are assembled by a process which should be apparent to those knowledgeable in the art.

The present invention, therefore, provides an inflatable device for people to sit, lie or sleep on which allows water vapor produced by the person's perspiration or condensation to escape from the vicinity of his/her body, which can be readily manufactured without undue amounts of human labor, which is suitable for disposable use, and which is of such a construction that in the event that there is a rupture or loss of pressure the entire device will not collapse.

Although the invention has been described with reference to a particular arrangement of parts, features and the like, these are not intended to exhaust all possible arrangements or features, and indeed many other modifications and variations will be ascertainable to those of skill in the art.

What is claimed is:

1. A cover for an inflatable cushion, which cushion is of a material that is substantially impermeable to water vapor and can support the weight of a human being thereon by containment of air therein, said cover comprising:

a breathable fill sheet adapted to overlie the cushion, said fill sheet permitting the passage of air and water vapor therethrough;

a top sheet overlying the fill sheet, said top sheet being of a material that permits the passage of air and water vapor therethrough, but that blocks the passage of liquid water therethrough, at least a portion of said top sheet being permanently bonded to at least a portion of the fill sheet;

wherein when a person is in contact with the cushion, water vapor between the person and the top sheet can pass through the top sheet and through the fill sheet away from the user.

2. The cover of claim 1 wherein said top sheet comprises breathable micropore material.

3. The cover of claim 2 wherein said top sheet comprises at least one of a polymer non-woven material and a polypropylene saturate material.

4. The cover of claim 1 wherein said fill sheet comprises polyester fill.

5. The cover of claim 1 wherein said cushion comprises at least one of polyethylene, polypropylene and polyurethane.

6. The cover of claim 1 wherein at least a portion of said top sheet and at least a portion of said cushion are permanently bonded together.

7. The cover of claim 6 wherein said top sheet and said cushion are permanently bonded together around substantially all of a perimeter of said top sheet and a perimeter of said cushion.

8. The cover of claim 1 wherein perimeters of said top sheet, said fill layer and said cushion are bonded together by at least one of heat sealing, sewing, and gluing.

9. The cover of claim 1 wherein the cushion is configured and inflated, and the fill sheet is selected of such a material, such that the compressibility of the fill sheet is less than that of the cushion so that the weight of the person does not compress the fill sheet against the cushion and block the breathability of the fill sheet.

10. The cover of claim 1 wherein said cushion comprises a mattress.

11. The cover of claim 1 wherein said cushion comprises a seat cushion.

12. The cover of claim 1 wherein said fill sheet and said top sheet are laminated together to form an integral sheet.

13. The cover of claim 1 wherein said fill sheet possesses antimicrobial properties.

14. The cover of claim 1 wherein said top sheet possesses antimicrobial properties.

15. An inflatable cushion comprising:

first and second sheets of polymeric material extending longitudinally and laterally and being secured together to form longitudinally spaced laterally extending support tubes;

said support tubes being pneumatically enclosed so as to be able to contain air therein at a pressure sufficient to support a person or portion thereof on the cushion;

said support tubes having lateral ends wherein material is bonded together, allowing the support tubes to inflate;

first and second laterally spaced, longitudinally extending side tubes adjacent respective lateral ends of the support tubes;

said sheets having therebetween a first air passage communicating with a plurality of said support tubes so that air may be supplied to said support tubes through said air passage to inflate or maintain air pressure in said support tubes;

said sheets having a second passage therebetween communicating with others of the support tubes and allowing delivery of air thereto; and said first passage communicating with a first subset of support tubes and said second passage communicating with a second subset of support tubes over the longitudinal length of the cushion.

16. The cushion of claim 15 further comprising a third passage communicating with a third subset of support tubes and allowing delivery of air thereto, and wherein said first, second and third passages communicate with support tubes over the longitudinal length of the cushion.

17. The cushion of claim 15 wherein said first passage communicates with the support tubes at longitudinal ends of the cushion, to provide inflated end rails, and the second passage communicates with the support tubes therebetween.

18. The cushion of claim 15 wherein each of said side tubes comprises an interior and each being connected with a respective set of the lateral ends of the support tubes.

19. The cushion of claim 18 further comprising a side rail air flow structure connected with the sheets and defining passages communicating with the interiors of the side tubes so that air introduced between the sheets can pass into the side tubes.

20. The cushion of claim 15 wherein said cushion comprises a mattress.

21. The cushion of claim 15 wherein said cushion comprises a seat cushion.

22. An inflatable cushion comprising:

first and second sheets of polymeric material extending longitudinally and laterally and being secured together to form longitudinally spaced laterally extending support tubes;

said support tubes being pneumatically enclosed so as to be able to contain air therein at a pressure sufficient to support a person or portion thereof on the cushion;

said support tubes having lateral ends wherein the material of the tubes is bonded together, allowing the support tubes to inflate;

first and second laterally spaced, longitudinally extending side tubes adjacent respective lateral ends of the support tubes;

said side tubes each having an interior and each being connected with a respective set of the lateral ends of the support tubes;

a side rail air flow structure connected with the sheets and defining passages communicating with the interiors of the side tubes so that air introduced between the sheets can pass into the side tubes; and said side rail air flow structures being configured so that air can flow therethrough only into, and not out of, the interiors of the side tubes.

23. The cushion of claim 22 wherein said side rail air flow structures comprise one-way flutter valve structures.

24. An inflatable cushion comprising:

first and second sheets of polymeric material extending longitudinally and laterally and being secured together to form longitudinally spaced laterally extending support tubes;

said support tubes being pneumatically enclosed so as to be able to contain air therein at a pressure sufficient to support a person or portion thereof on the cushion;

said support tubes having lateral ends wherein the material of the tubes is bonded together, allowing the support tubes to inflate;

first and second laterally spaced, longitudinally extending side tubes adjacent respective lateral ends of the support tubes; and a center sheet bonded between the two sheets of polymeric material, said center sheet defining in each of the support tubes a lower tube interior and an upper tube interior.

25. The cushion of claim 24 further comprising air flow means permitting passage of air in the upper tube interior into the lower tube interior.

26. The cushion of claim 25 wherein said air flow means prevents passage of air in the lower tube interior into the upper tube interior so that, in the event of a loss of pressure in the upper tube interior, pressure is nonetheless maintained in the lower tube interior.

27. An inflatable cushion comprising:

first and second sheets of polymeric material extending longitudinally and laterally and being secured together to form longitudinally spaced laterally extending support tubes;

said support tubes being pneumatically enclosed so as to be able to contain air therein at a pressure sufficient to support a person or portion thereof on the cushion;

said support tubes having lateral ends wherein the material of the tubes is bonded together, allowing the support tubes to inflate;

first and second laterally spaced, longitudinally extending side tubes adjacent respective lateral ends of the support tubes;

said sheets having therebetween a first air passage communicating with a plurality of said support tubes so that air may be supplied to said support tubes through said air passage to inflate or maintain air pressure in said support tubes;

said sheets having a second passage therebetween communicating with others of the support tubes and allowing delivery of air thereto;

said first passage communicating with the support tubes at longitudinal ends of the cushion, to provide inflated ends of the cushion, and the second passage communicating with the support tubes therebetween; and an air flow structure forming a tube extending generally longitudinally between the first and second sheets and defining a passage therein communicating with some of the support tubes to permit supply of air thereto.

28. The cushion of claim 27 further comprising a second air flow structure forming a second tube extending generally longitudinally between the first and second sheets and defining therein a second passage communicating with others of the support tubes.

29. The cushion of claim 28 further comprising a third air flow structure forming a third tube extending generally longitudinally between the first and second sheets and defining therein a third passage communicating with others of the support tubes.

30. The cushion of claim 28 wherein said first and second passages each communicate with respective side tubes for supplying air thereto.

31. The cushion of claim 29 wherein said first, second and third passages each communicate with respective side tubes for supplying air thereto.

32. The cushion of claim 28 further comprising one-way flow structures between the side tubes and the associated passages so that air can flow only from the passage into the associated side tube, and not in the opposite direction, so that said side tubes do not immediately deflate when pressure leaves the passage.

33. The cushion of claim 32 wherein said flow structures include means defining apertures connecting the side tubes with lower tube interiors so that the side tubes and the lower tube interiors remain inflated even when air is not supplied through the passages.

34. The cushion of claim 28 wherein said cushion comprises a mattress.

35. The cushion of claim 28 wherein said cushion comprises a seat cushion.

36. An inflatable cushion system comprising:

first and second sheets of polymeric material extending longitudinally and laterally and being secured together to form longitudinally spaced laterally extending support tubes;

said support tubes being pneumatically enclosed so as to be able to contain air therein at a pressure sufficient to support a person or portion thereof on the cushion;

said support tubes having lateral ends wherein the material of the tubes is bonded together, allowing the support tubes to inflate;

first and second laterally spaced, longitudinally extending side tubes adjacent respective lateral ends of the support tubes;

a fill layer of porous material overlying at least one of the first and second sheets of polymeric material, and a top sheet overlying the fill layer, said top sheet being of a material that prevents the passage of liquid water but allows the passage of water vapor, whereby water vapor for a user in contact with the cushion can pass through the top layer, through the fill layer, and away from the user.

37. The cushion system of claim 36, wherein said top sheet is connected with the support tubes to remain in place thereon.

38. The cushion system of claim 36 wherein said fill layer and top sheet span areas between high points of the support tubes and provide support of the user therebetween.

39. The cushion of claim 36 wherein said cushion comprises a mattress.

40. The cushion of claim 36 wherein said cushion comprises a seat cushion.

41. The cushion of claim 36 wherein at least one of the first and second sheets of polymeric material includes small holes so that air pumped into the cushion can flow out through the fill layer to better ventilate points of contact of a user's body with the cushion.

42. An inflatable cushion system comprising:

an inflatable cushion; and a pump supplying air to the inflatable cushion for inflation thereof; and wherein the inflatable cushion comprises:

a middle portion receiving air from the pump and being inflated thereby, said middle portion having two lateral sides;

a pair of side tubes each attached to a respective side of the middle portion;

said middle portion including air flow structures transmitting air in the middle portion to the side tubes, said air flow structures blocking air flow therethrough from the side tubes to the middle portion so that, when the middle portion deflates or loses air pressure therein, the side tubes remain inflated.

43. The cushion system of claim 42 wherein said middle portion defines therein an interior space and wherein said middle portion includes a center sheet dividing said interior space into one or more upper spaces and one or more lower spaces.

44. The cushion system of claim 43 wherein said middle portion comprises a bottom sheet defining said lower space or spaces therewith.

45. The cushion system of claim 44 wherein said bottom sheet is connected to a lower surface of said center sheet in a plurality of locations so as to form a plurality of laterally extending lower support tubes defining the lower spaces.

46. The cushion system of claim 45 wherein said bottom sheet is connected to the center sheet so as to form downwardly disposed recesses extending laterally across the cushion so as to provide for easier bending of said cushion on an articulated frame.

47. The cushion system of claim 45 wherein said middle portion comprises an upper sheet connected to an upper surface of said center sheet in a plurality of locations so as to form a plurality of laterally extending upper support tubes defining the upper spaces.

48. The cushion system of claim 47 wherein the upper sheet, the center sheet, and the bottom sheet are all bonded together in laterally extending seals so as to form a plurality of support tubes between said side tubes.

49. The cushion system of claim 47 wherein the side tubes each comprise an interior communicating with the lower spaces of the lower support tubes so that air flows therebetween, and so that, if the upper support tubes lose air pressure, the lower support tubes and the side tubes remain inflated.

50. The cushion system of claim 43 wherein said side tubes each comprise an interior communicating with the lower spaces so that, in the event of a loss of pressure in the upper spaces, the middle portion lower spaces and the side tubes remain inflated.

51. The cushion system of claim 42 wherein said cushion further comprises:

a fill sheet of porous material overlying the support tubes;

a top sheet overlying the fill layer and being connected with the support tubes to remain in place thereon, said top sheet being of a material that prevents the passage of liquid water but allows the passage of water vapor, whereby water vapor for a user in contact with the cushion can pass through the top layer, through the fill layer, and away from the user.

52. The cushion system of claim 51 wherein said fill layer and top sheet span areas between high points of the support tubes and providing support of the user therebetween.

53. The cushion system of claim 51 wherein at least a portion of the cushion includes small holes so that air pumped into the cushion can flow out through the fill layer to better ventilate points of contact of a user's body with the cushion.

54. The cushion system of claim 42 wherein said cushion comprises a mattress.

55. The cushion system of claim 42 wherein said cushion comprises a seat cushion.

56. An inflatable cushion comprising:

first and second sheets of polymeric material extending longitudinally and laterally and being secured together to form longitudinally spaced laterally extending support tubes;

said support tubes being pneumatically enclosed so as to be able to contain air therein at a pressure sufficient to support a person or portion thereof on the cushion;

said support tubes having lateral ends wherein the material of the tubes is bonded together, allowing the support tubes to inflate; and a center sheet bonded between the two sheets of polymeric material, said center sheet defining in each of the support tubes a lower tube interior and an upper tube interior.

57. The cushion of claim 55 further comprising air flow means permitting passage of air in the upper tube interior into the lower tube interior.

58. The cushion of claim 57 wherein said air flow means prevent passage of air in the lower tube interior into the upper tube interior so that, in the event of a loss of pressure in the upper tube interior, pressure is nonetheless maintained in the lower tube interior.

59. The cushion of claim 56 wherein said cushion comprises a mattress.

60. The cushion of claim 56 wherein said cushion comprises a seat cushion.

61. An inflatable cushion comprising:

first and second sheets of polymeric material extending longitudinally and laterally and being secured together to form longitudinally spaced laterally extending support tubes;

said support tubes being pneumatically enclosed so as to be able to contain air therein at a pressure sufficient to support a person or portion thereof on the cushion;

said support tubes having lateral ends wherein the material of the tubes is bonded together, allowing the support tubes to inflate;

said sheets having therebetween a first air passage communicating with a plurality of said support tubes so that air may be supplied to said support tubes through said air passage to inflate or maintain air pressure in said support tubes;

said sheets having a second passage therebetween communicating with others of the support tubes and allowing delivery of air thereto; and an air flow structure forming a tube extending generally longitudinally between the first and second sheets and defining a passage therein communicating with some of the support tubes to permit supply of air thereto.

62. The cushion of claim 61 further comprising a second air flow structure forming a second tube extending generally longitudinally between the first and second sheets and defining therein a second passage communicating with others of the support tubes.

63. The cushion of claim 62 further comprising a third air flow structure forming a third tube extending generally longitudinally between the first and second sheets and defining therein a third passage communicating with others of the support tubes.

64. The cushion of claim 61 wherein said cushion comprises a mattress.

65. The cushion of claim 61 wherein said cushion comprises a seat cushion.

66. An inflatable cushion system comprising:

first and second sheets of polymeric material extending longitudinally and laterally and being secured together to form longitudinally spaced laterally extending support tubes;

said support tubes being pneumatically enclosed so as to be able to contain air therein at a pressure sufficient to support a person or portion thereof on the cushion;

said support tubes having lateral ends wherein the material of the tubes is bonded together, allowing the support tubes to inflate;

a fill layer of porous material overlying at least one of the first and second sheets of polymeric material, and a top sheet overlying the fill layer, said top sheet being of a material that prevents the passage of liquid water but allows the passage of water vapor, whereby water vapor for a user in contact with the cushion can pass through the top layer, through the fill layer, and away from the user.

67. The cushion system of claim 66, wherein said top sheet is connected with the support tubes to remain in place thereon.

68. The cushion system of claim 66 wherein said fill layer and top sheet span areas between high points of the support tubes and provide support of the user therebetween.

69. The cushion of claim 66 wherein said cushion comprises a mattress.

70. The cushion of claim 66 wherein said cushion comprises a seat cushion.

71. The cushion of claim 66 wherein at least one of the first and second sheets of polymeric material includes small holes so that air pumped into the cushion can flow out through the fill layer to better ventilate points of contact of a user's body with the cushion.

* * * * *